US007533017B2

(12) United States Patent
Gotanda et al.

(10) Patent No.: US 7,533,017 B2
(45) Date of Patent: May 12, 2009

(54) METHOD FOR RECOVERING TARGET SPEECH BASED ON SPEECH SEGMENT DETECTION UNDER A STATIONARY NOISE

(75) Inventors: Hiromu Gotanda, Fukuoka (JP); Keiichi Kaneda, Fukuoka (JP); Takeshi Koya, Fukuoka (JP)

(73) Assignee: Kitakyushu Foundation for the Advancement of Industry, Science and Technology (JP)

( * ) Notice: Subject to any disclaimer, the term of this patent is extended or adjusted under 35 U.S.C. 154(b) by 634 days.

(21) Appl. No.: 10/570,808

(22) PCT Filed: Aug. 31, 2004

(86) PCT No.: PCT/JP2004/012899

§ 371 (c)(1),
(2), (4) Date: Mar. 6, 2006

(87) PCT Pub. No.: WO2005/029463

PCT Pub. Date: Mar. 31, 2005

(65) Prior Publication Data

US 2007/0055511 A1 Mar. 8, 2007

(30) Foreign Application Priority Data

Sep. 5, 2003 (JP) ..... 2003-314247

(51) Int. Cl.
*G10L 21/02* (2006.01)

(52) U.S. Cl. ..... 704/226; 704/228; 704/233

(58) Field of Classification Search ..... 704/226, 704/228, 233; 381/94.2, 94.3
See application file for complete search history.

(56) References Cited

U.S. PATENT DOCUMENTS 6,246,978 B1 * 6/2001 Hardy ..... 704/201

(Continued)

FOREIGN PATENT DOCUMENTS

WO WO 02/29780 A3 4/2002

OTHER PUBLICATIONS

J Bell et al, An Information-Maximization Approach to Blind Separation and blind Deconvolution, Neural Computation, Jun. 1995, vol. 7, No. 6.

(Continued)

*Primary Examiner*—Daniel D Abebe
(74) *Attorney, Agent, or Firm*—Pepper Hamilton LLP

(57) ABSTRACT

Method for recovering target speech by extracting signal components falling in a speech segment, which is determined based on separated signals obtained through the Independent Component Analysis, thereby minimizing the residual noise in the recovered target speech. The present method comprises: the first step of receiving target speech emitted from a sound source and a noise emitted from another sound source and extracting estimated spectra Y* corresponding to the target speech by use of the Independent Component Analysis; the second step of separating from the estimated spectra Y* an estimated spectrum series group y* in which the noise is removed by applying separation judgment criteria based on the kurtosis of the amplitude distribution of each of estimated spectrum series in Y*; the third step of detecting a speech segment and a noise segment of the total sum F of all the estimated spectrum series in y* by applying detection judgment criteria based on a predetermined threshold value T that is determined by the maximum value of F; and the fourth step of extracting components falling in the speech segment from the estimated spectra Y* to generate a recovered spectrum group of the target speech for recovering the target speech.

9 Claims, 11 Drawing Sheets

U.S. PATENT DOCUMENTS

| | | | | |
|---|---|---|---|---|
| 2004/0049383 | A1 * | 3/2004 | Kato et al. | 704/226 |
| 2007/0021958 | A1 * | 1/2007 | Visser et al. | 704/226 |
| 2007/0038442 | A1 * | 2/2007 | Visser et al. | 704/233 |
| 2008/0201138 | A1 * | 8/2008 | Visser et al. | 704/227 |

OTHER PUBLICATIONS

S Amari, Natural Gradient Works Efficiently in Learning, Feb. 1998, vol. 10, No. 2, pp. 254-276, MIT Press, USA.

T.W. Lee et al, Independent Component Analysis Using . . . Mixed Subgaussian and Supergaussian Sources, Feb. 1999, vol. 11, No. 2 pp. 417-441, MIT Press, USA.

A Hyvarinen, Fast and Robust Fixed-Point Algorithms for Independent component Analysis, 1999, vol. 10(3), pp. 626-634, IEEE Trans. on Neural Networks.

A Hyvarinen, Independent Component Analysis: Algorithms and Applications, 2000, vol. 13(4-5), pp. 411-430, Neural Networks.

H. Gontanda et al, Permutation Correction and Speech Extraction Based on Split Spectrum Through FastICA, 4th International Symposium on Independent Component Analysis and Blind Signal Separation (ICA2003), Apr. 2003, Nara, Japan.

* cited by examiner

METHOD FOR RECOVERING TARGET SPEECH BASED ON SPEECH SEGMENT DETECTION UNDER A STATIONARY NOISE

CROSS REFERENCE TO RELATED APPLICATIONS

This application is the U.S. national phase of PCT/JP2004/012899, filed Aug. 31, 2004, which claims priority under 35 U.S.C. 119 to Japanese Patent Application No. 2003-314247, filed on Sep. 5, 2003. The entire disclosure of the aforesaid application is incorporated herein by reference.

BACKGROUND OF THE INVENTION

1. Field of the Invention

The present invention relates to a method for recovering target speech based on speech segment detection under a stationary noise by extracting signal components falling in a speech segment, which is determined based on separated signals obtained through the Independent Component Analysis (ICA), thereby minimizing the residual noise in the recovered target speech.

2. Description of the Related Art

Recently the speech recognition technology has significantly improved and achieved provision of speech recognition engines with extremely high recognition capabilities for the case of ideal environments, i.e. no surrounding noises. However, it is still difficult to attain a desirable recognition rate in a household environment or offices where there are sounds of daily activities and the like. In order to take advantage of the inherent capability of the speech recognition engine in such environments, pre-processing is needed to remove noises from the mixed signals and pass only the target speech such as a speaker's speech to the engine.

In this respect, the ICA and other speech emphasizing methods have been widely utilized and various algorithms have been proposed. (For example, see the following five references: 1. *"An Information Maximization Approach to Blind Separation and Blind Deconvolution"*, by J. Bell and T. J. Sejnowski, Neural Computation, USA, MIT Press, Jun. 1995, Vol. 7, No. 6, pp 1129-1159; 2. *"Natural Gradient Works Efficiently in Learning"*, by S. Amari, Neural Computation, USA, MIT Press, February 1998, Vol. 10, No. 2, pp. 254-276; 3. *"Independent Component Analysis Using an Extended Informax Algorithm for Mixed Sub-Gaussian and Super-Gaussian Sources"*, by T. W. Lee, M. Girolami, and T. J. Sejnowski, Neural Computation, USA, MIT Press, February 1999, Vol. 11, No. 2, pp. 417-441; 4. *"Fast and Robust Fixed-Point Algorithms for Independent Component Analysis"*, by A Hyvarinen, IEEE Trans. Neural Networks, USA, IEEE, June 1999, Vol. 10, No. 3, pp. 626-634; and 5. *"Independent Component Analysis: Algorithms and Applications"*, by A. Hyvarinen and E. Oja, Neural Networks, USA, Pergamon Press, June 2000, Vol. 13, No. 4-5, pp. 411-430.) Among various algorithms, the ICA is a method for separating noises from speech on the assumption that the sound sources are statistically independent.

Although the ICA is capable of separating noises from speech well under ideal conditions without reverberation, its separation ability greatly degrades under real-life conditions with strong reverberation due to residual noises caused by the reverberation.

SUMMARY OF THE INVENTION

In view of the above situations, the objective of the present invention is to provide a method for recovering target speech from signals received in a real-life environment. Based on the separated signals obtained through the ICA, a speech segment and a noise segment are defined. Thereafter signal components falling in the speech segment are extracted so as to minimize the residual noise in the recovered target speech.

According to a first aspect of the present invention, the method for recovering target speech based on speech segment detection under a stationary noise comprises: the first step of receiving target speech emitted from a sound source and a noise emitted from another sound source and forming mixed signals at a first microphone and at a second microphone, which are provided at separate locations, performing the Fourier transform of the mixed signals from the time domain to the frequency domain, and extracting estimated spectra Y* and Y corresponding to the target speech and the noise by use of the Independent Component Analysis; the second step of separating the estimated spectra Y* into an estimated spectrum series group y* in which the noise is removed and an estimated spectrum series group y in which the noise remains by applying separation judgment criteria based on the kurtosis of the amplitude distribution of each of estimated spectrum series in Y*; the third step of detecting a speech segment and a noise segment in the frame number domain of the total sum 65 of all the estimated spectrum series in y* by applying detection judgment criteria based on a predetermined threshold value β that is determined by the maximum value of F; and the fourth step of extracting components falling in the speech segment from each of the estimated spectrum series in Y* to generate a recovered spectrum group of the target speech, and performing the inverse Fourier transform of the recovered spectrum group from the frequency domain to the time domain to generate a recovered signal of the target speech.

The target speech and noise signals received at the first and second microphones are mixed and convoluted. By transforming the signals from the time domain to the frequency domain, the convoluted mixing can be treated as instant mixing, making the separation procedure relatively easy. In addition, the sound sources are considered to be statistically independent; thus, the ICA can be employed.

Since split spectra obtained through the ICA contain scaling ambiguity and permutation at each frequency, it is necessary to solve these problems first in order to extract the estimated spectra Y* and Y corresponding to the target speech and the noise respectively. Even after that, the estimated spectra Y* at some frequencies still contain the noise.

There is a well known difference in statistical characteristics between speech and a noise in the time domain. That is, the amplitude distribution of speech has a high kurtosis with a high probability of occurrence around 0, whereas the amplitude distribution of a noise has a low kurtosis. The same characteristics are expected to be observed even after performing the Fourier transform of the speech and noise signals from the time domain to the frequency domain. At each frequency, a plurality of components form a spectrum series according to the frame number used for discretization. Therefore, by examining the kurtosis of the amplitude distribution of the estimated spectrum series in Y* at one frequency, it can be judged that, if the kurtosis is high, the noise is well removed at the frequency; and if the kurtosis is low, the noise still remains at the frequency. Consequently, each spectrum series in Y* can be assigned to either the estimate spectrum series group y* or y.

Since the frequency components of a speech signal varies with time, the frame-number range characterizing speech varies from an estimated spectrum series to an estimated spectrum series in y*. By taking a summation of all the estimated spectrum series in y* at each frame number and by specifying a threshold value β depending on the maximum value of F, the speech segment and the noise segment can be clearly defined in the frame-number domain.

Therefore, noise components are practically non-existent in the recovered spectrum group, which is generated by extracting components falling in the speech segment from the estimated spectra Y*. The target speech is thus obtained by performing the inverse Fourier transform of the recovered spectrum group from the frequency domain to the time domain.

It is preferable that the detection judgment criteria define the speech segment as a frame-number range where the total sum F is greater than the threshold value β and the noise segment as a frame-number range where the total sum F is less than or equal to the threshold value β. Accordingly, a speech segment detection function, which is a two-valued function for selecting either the speech segment or the noise segment depending on the threshold value β, can be defined. By use of this function, components falling in the speech segment can be easily extracted.

According to a second aspect of the present invention, the method for recovering target speech based on speech segment detection under a stationary noise comprises: the first step of receiving target speech emitted from a sound source and a noise emitted from another sound source and forming mixed signals at a first microphone and at a second microphone, which are provided at separate locations, performing the Fourier transform of the mixed signals from the time domain to the frequency domain, and extracting estimated spectra Y* and Y corresponding to the target speech and the noise by use of the Independent Component Analysis; the second step of separating the estimated spectra Y* into an estimated spectrum series group y* in which the noise is removed and an estimated spectrum series group y in which the noise remains by applying separation judgment criteria based on the kurtosis of the amplitude distribution of each of estimated spectrum series in Y*; the third step of detecting a speech segment and a noise segment in the time domain of the total sum F of all the estimated spectrum series in y* by applying detection judgment criteria based on a predetermined threshold value β that is determined by the maximum value of F; and the fourth step of performing the inverse Fourier transform of the estimated spectra Y* from the frequency domain to the time domain to generate a recovered signal of the target speech and extracting components falling in the speech segment from the recovered signal of the target speech to recover the target speech.

At each frequency, a plurality of components form a spectrum series according to the frame number used for discretization. There is a one-to-one relationship between the frame number and the sampling time via the frame interval. By use of this relationship, the speech segment detected in the frame-number domain can be converted to the corresponding speech segment in the time domain. The other time interval can be defined as the noise segment. The target speech can thus be recovered by performing the inverse Fourier transform of the estimated spectra Y* from the frequency domain to the time domain to generate the recovered signal of the target speech and extracting components falling in the speech segment from the recovered signal in the time domain.

It is preferable that the detection judgment criteria define the speech segment as a time interval where the total sum F is greater than the threshold value β and the noise segment as a time interval where the total sum F is less than or equal to the threshold value β. Accordingly, a speech segment detection function, which is a two-valued function for selecting either the speech segment or the noise segment depending on the threshold value β, can be defined. By use of this function, components failing in the speech segment can be easily extracted.

It is preferable, in both the first and second aspects of the present invention, that the kurtosis of the amplitude distribution of each of the estimated spectrum series in Y* is evaluated by means of entropy E of the amplitude distribution. The entropy E can be used for quantitatively evaluating the uncertainty of the amplitude distribution of each of the estimated spectrum series in Y*. In this case, the entropy E decreases as the noise is removed. Incidentally, for a quantitative measure of the kurtosis, $\mu/\sigma^4$ may be used, where μ is the fourth moment around the mean and σ is the standard deviation. However, it is not preferable to use this measure because of its non-robustness in the presence of outliers. Statistically, a kurtosis is defined as the fourth order statistics as above. On the other hand, entropy is expressed as the weighted summation of all the moments ($0^{th}$, $1^{st}$, $2^{nd}$, $3^{rd}$ . . . ) by the Taylor expansion. Therefore, entropy is a statistical measure that contains a kurtosis as its part.

It is preferable, in both the first and second aspects of the present invention, that the separation judgment criteria are given as:

(1) if the entropy E of an estimated spectrum series in Y* is less than a predetermined threshold value α, the estimated spectrum series in Y* is assigned to the estimated spectrum series group y*; and (2) if the entropy E of an estimated spectrum series in Y* is greater than or equal to the threshold value α, the estimated spectrum series in Y* is assigned to the estimated spectrum series group y.

The noise is well removed from the estimated spectrum series in Y* at some frequencies, but not from the others. Therefore, the entropy varies with ω. If the entropy E of an estimated spectrum series in Y* is less than the threshold value α, the estimated spectrum series in Y* is assigned to the estimated spectrum series group y* in which the noise is removed; and if the entropy E of an estimated spectrum series in Y* is greater than or equal to the threshold value α, the estimated spectrum series in Y* is assigned to the estimated spectrum series group y in which the noise remains.

Based on the separation judgment criteria, which determine the selection of y* or y depending on α, it is easy to separate Y* into y* and y.

According to the present invention as described in claims 1, 2, 5, and 6, it is possible to extract signal components falling only in the speech segment, which is determined from the estimated spectra corresponding to the target speech, from the received signals under real-life conditions. Thus, the residual noise can be minimized to recover target speech with high quality. As a result, input operations by means of speech recognition in a noisy environment, such as voice commands or input for OA, for storage management in logistics, and for operating car navigation systems, may be able to replace the conventional input operations by use of fingers, touch censors, or keyboards.

According to the present invention as described in claim 2, it is possible to easily define the frame-number range characterizing the target speech in each estimated spectrum series in Y*; thus, the speech segment can be quickly detected. As a result, it is possible to provide a speech recognition engine with a fast response time of speech recovery under real-life conditions, and at the same time, with high recognition ability.

According to the present invention as described in claim 3, it is possible to extract signal components falling only in the speech segment in the time domain, which is determined from the estimated spectra corresponding to the target speech, from the received signals under real-life conditions. Thus, the residual noise can be minimized to recover target speech with high quality. As a result, input operations by means of speech recognition in a noisy environment, such as voice commands or input for OA, for storage management in logistics, and for operating car navigation systems, may be able to replace the conventional input operations by use of fingers, touch censors, or keyboards.

According to the present invention as described in claim 4, it is possible to easily define the time interval characterizing the target speech in the recovered signal of the target speech with the minimal calculation load. As a result, it is possible to provide a speech recognition engine with a fast response time of speech recovery under real-life conditions, and at the same time, with high recognition ability.

According to the present invention as described in claim 5, it is possible to evaluate the kurtosis of the amplitude distribution of each of the estimated spectrum series in Y* even in the presence of outliers. Thus, it is possible to unambiguously select the estimated spectrum series in Y* into y* in which the noise is removed and y in which the noise remains.

According to the present invention as described in claim 6, it is possible to unambiguously select the estimated spectrum series in Y* into y* in which the noise is removed and y in which the noise remains with the minimal calculation load. As a result, it is possible to provide a speech recognition engine with a fast response time of speech recovery under real-life conditions, and at the same time, with high recognition ability.

DETAILED DESCRIPTION OF THE PREFERRED EMBODIMENTS

Embodiments of the present invention are described below with reference to the accompanying drawings to facilitate understanding of the present invention.

Figure 1:
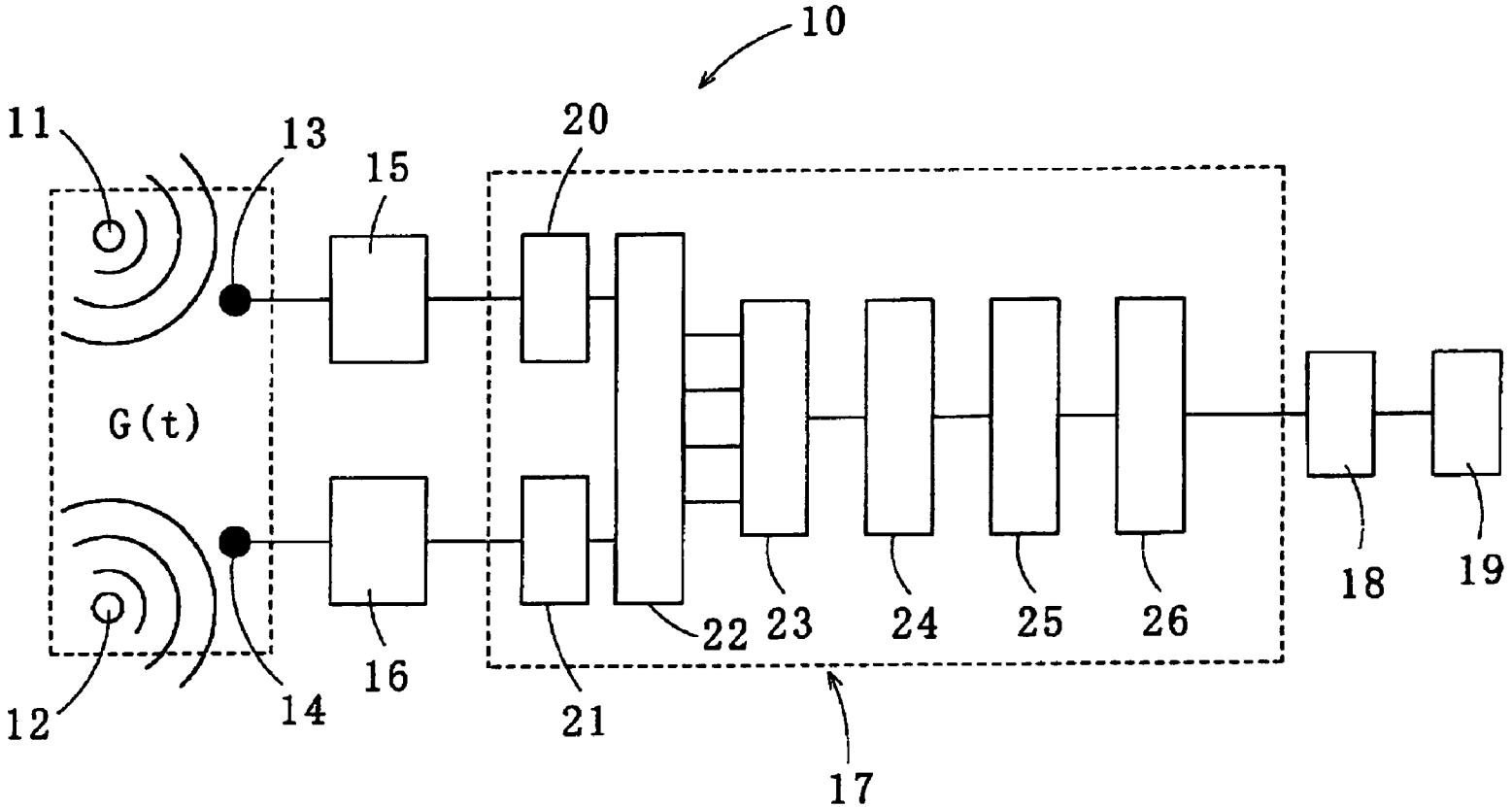
FIG. 1 is a block diagram showing a target speech recovering apparatus employing the method for recovering target speech based on speech segment detection under a stationary noise according to the first and second embodiments of the present invention.

As shown in FIG. 1, a target speech recovering apparatus 10, which employs a method for recovering target speech based on speech segment detection under a stationary noise according to the first and second embodiments of the present invention, comprises two sound sources 11 and 12 (one of which is a target speech source and the other is a noise source, although they are not identified), a first microphone 13 and a second microphone 14, which are provided at separate locations for receiving mixed signals transmitted from the two sound sources, a first amplifier 15 and a second amplifier 16 for amplifying the mixed signals received at the microphones 13 and 14 respectively, a recovering apparatus body 17 for separating the target speech and the noise from the mixed signals entered through the amplifiers 15 and 16 and outputting recovered signals of the target speech and the noise, a recovered signal amplifier 18 for amplifying the recovered signals outputted from the recovering apparatus body 17, and a loudspeaker 19 for outputting the amplified recovered signals. These elements are described in detail below.

For the first and second microphones 13 and 14, microphones with a frequency range wide enough to receive signals over the audible range (10-20000 Hz) may be used. Here, the first microphone 13 is placed more closely to the sound source 11 than the second microphone 14 is, and the second microphone 14 is placed more closely to the sound source 12 than the first microphone 13 is.

For the amplifiers 15 and 16, amplifiers with frequency band characteristics that allow non-distorted amplification of audible signals may be used.

The recovering apparatus body 17 comprises A/D converters 20 and 21 for digitizing the mixed signals entered through the amplifiers 15 and 16, respectively.

The recovering apparatus body 17 further comprises a split spectra generating apparatus 22, equipped with a signal separating arithmetic circuit and a spectrum splitting arithmetic circuit. The signal separating arithmetic circuit performs the Fourier transform of the digitized mixed signals from the time domain to the frequency domain, and decomposes the mixed signals into two separated signals $U_1$ and $U_2$ by means of the Fast ICA. Based on transmission path characteristics of the four possible paths from the two sound sources 11 and 12 to the first and second microphones 13 and 14, the spectrum splitting arithmetic circuit generates from the separated signal $U_1$ one pair of split spectra $v_{11}$ and $v_{12}$ which were received at the first microphone 13 and the second microphone 14 respectively, and generates from the separated signal $U_2$ another pair of split spectra $v_{21}$ and $v_{22}$ which were received at the first microphone 13 and the second microphone 14 respectively.

The recovering apparatus body 17 further comprises an estimated spectra extracting circuit 23 for extracting estimated spectra Y* of the target speech, wherein the split spectra $v_{11}$, $v_{12}$, $v_{21}$, and $v_{22}$ are analyzed by applying criteria based on sound transmission characteristics that depend on the four different distances between the first and second microphones 13 and 14 and the sound sources 11 and 12 to assign each split spectrum to the target speech or to the noise.

The recovering apparatus body 17 further comprises a speech segment detection circuit 24 for separating the estimated spectra Y* into an estimated spectrum series group y* in which the noise is removed and an estimated spectrum series group y in which the noise remains by applying separation judgment criteria based on the kurtosis of the amplitude distribution of each of the estimated spectrum series in Y*, and detecting a speech segment in the frame-number domain of a total sum F of all the estimated specs series in y* by applying detection judgment criteria based on a threshold value β that is determined by the maximum value of F.

The recovering apparatus body 17 further comprises a recovered spectra extracting circuit 25 for extracting components falling in the speech segment from each of the estimated spectrum series in Y* to generate a recovered spectrum group of the target speech.

The recovering apparatus body 17 further comprises a recovered signal generating circuit 26 for performing the inverse Fourier transform of the recovered spectrum group from the frequency domain to the time domain to generate the recovered signal of the target speech.

The split spectra generating apparatus 22, equipped with the signal separating arithmetic circuit and the speck splitting arithmetic circuit, the estimated spectra extracting circuit 23, the speech segment detection circuit 24, the recovered spectra extracting circuit 25, and the recovered signal generating circuit 26 may be structured by loading programs for executing each circuit's functions on, for example, a personal computer. Also, it is possible to load the programs on a plurality of microcomputers and form a circuit for collective operation of these microcomputers.

In particular, if the programs are loaded on a personal computer, the entire recovering apparatus body 17 may be structured by incorporating the A/D converters 20 and 21 into the personal computer.

For the recovered signal amplifier 18, an amplifier that allows analog conversion and non-distorted amplification of audible signals may be used. A loudspeaker that allows non-distorted output of audible signals may be used for the loudspeaker 19.

Figure 2:
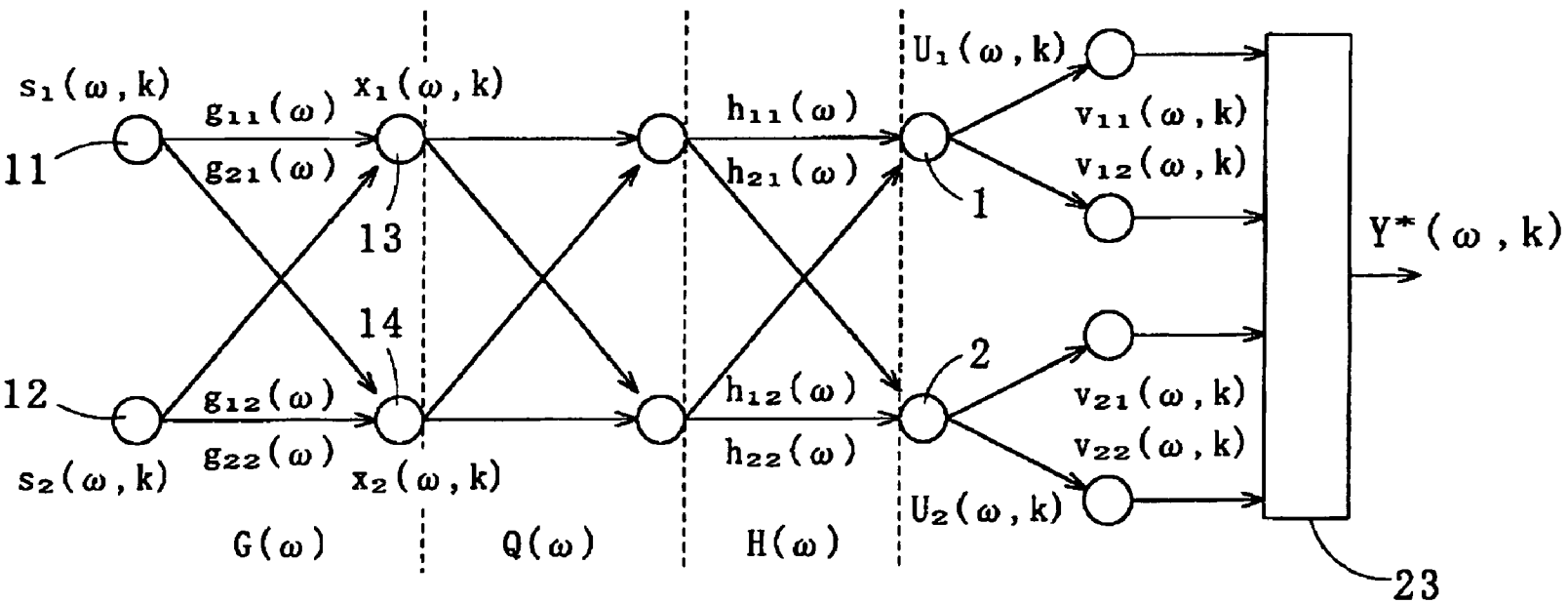
FIG. 2 is an explanatory view showing a signal flow in which a recovered spectrum is generated from the target speech and the noise per the method in FIG. 1.

The method for recovering target speech based on speech segment detection under a stationary noise according to the first embodiment of the present invention comprises: the first step of receiving a signal $s_1(t)$ from the sound source 11 and a signal $s_2(t)$ from the sound source 12 at the first and second microphones 13 and 14 and forming mixed signals $x_1(t)$ and $x_2(t)$ at the first microphone 13 and at the second microphone 14 respectively, performing the Fourier transform of the mixed signals $x_1(t)$ and $x_2(t)$ from the time domain to the frequency domain, and extracting estimated spectra Y* and Y corresponding to the target speech and the noise by use of the Fast ICA, as shown in FIG. 2; the second step of separating the estimated spectra Y* into an estimated spectrum series group y* in which the noise is removed and an estimated spectrum series group y in which the noise remains by applying separation judgment criteria based on the kurtosis of the amplitude distribution of each of the estimated spectrum series in Y*; the third step of detecting a speech segment and a noise segment in the frame-number domain of a total sum F of all the estimated spectrum series in y* by applying detection judgment criteria based on a threshold value β that is determined by the maximum value of F; and the fourth step of extracting components falling in the speech segment from each of the estimated spectrum series in Y* to generate a recovered spectrum group of the target speech, and performing the inverse Fourier transform of the recovered spectrum group from the frequency domain to the time domain to generate the recovered signal of the target speech. The above steps are described in detail below. Here, "t" represents time throughout.

1. First Step

In general, the signal $s_1(t)$ from the sound source 11 and the signal $s_2(t)$ from the sound source 12 are assumed to be statistically independent of each other. The mixed signals $x_1(t)$ and $x_2(t)$, which are obtained by receiving the signals $s_1(t)$ and $s_2(t)$ at the microphones 13 and 14 respectively, are expressed as in Equation (1):

$$x(t)=G(t)*s(t) \tag{1}$$

where $s(t)=[s_1(t), s_2(t)]^T$, $x(t)=[x_1(t), x_2(t)]^T$, * is a convolution operator, and G(t) represents transfer functions from the sound sources 11 and 12 to the first and second microphones 13 and 14.

As in Equation (1), when the signals from the sound sources 11 and 12 are convoluted, it is difficult to separate the signals $s_1(t)$ and $s_2(t)$ from the mixed signals $x_1(t)$ and $x_2(t)$ in the time domain. Therefore, the mixed signals $x_1(t)$ and $x_2(t)$ are divided into short time intervals (frames) and are transformed from the time domain to the frequency domain for each frame as in Equation (2):

$$x_j(\omega, k) = \sum_t e^{-\sqrt{-1}\,\omega t} x_j(t) w(t - k\tau) \tag{2}$$

$$(j = 1, 2;\ k = 0, 1, \ldots, K-1)$$

where ω(=0, 2π/M, . . . , 2π(M−1)/M) is a normalized frequency, M is the number of sampling in a frame, w(t) is a window function, τ is a frame interval, and K is the number of frames. For example, the time interval can be about several 10 msec. In this way, it is also possible to treat the spectra as a group of spectrum series by laying out the components at each frequency in the order of frames. Moreover, in the frequency domain, it is possible to treat the recovery problems just like in the case of instant mixing.

In this case, mixed signal spectra x(ω,k) and corresponding spectra of the signals $s_1(t)$ and $s_2(t)$ are related to each other in the frequency domain as in Equation (3):

$$x(\omega, k)=G(\omega)s(\omega, k) \tag{3}$$

where s(ω,k) is the discrete Fourier transform of a windowed s(t), and G(ω) is a complex number matrix that is the discrete Fourier transform of G(t).

Since the signal spectra $s_1(\omega,k)$ and $S_2(\omega,k)$ are inherently independent of each other, if mutually independent separated signal spectra $U_1(\omega,k)$ and $U_2(\omega,k)$ are calculated from the mixed signal spectra x(ω,k) by use of the Fast ICA, these separated spectra will correspond to the signal spectra $s_1(\omega,k)$ and $s_2(\omega,k)$ respectively. In other words, by obtaining a separation matrix H(ω)Q(ω) with which the relationship expressed in Equation (4) is valid between the mixed signal spectra x(ω,k) and the separated signal spectra $U_1(\omega,k)$ and $U_2(\omega,k)$, it becomes possible to determine the mutually independent separated signal spectra $U_1(\omega,k)$ and $U_2(\omega,\omega,k)$ from the mixed signal spectra x(ω,k).

$$u(\omega, k)=H(\omega)Q(\omega)x(\omega) \tag{4}$$

where $u(\omega,k)=[U_1(\omega,k),U_2(\omega,k)]^T$.

Incidentally, in the frequency domain, amplitude ambiguity and permutation occur at individual frequencies as in Equation (5):

$$H(\omega)Q(\omega)G(\omega)=PD(\omega) \tag{5}$$

where H(ω) is defined later in Equation (10), Q(ω) is a whitening matrix, P is a matrix representing permutation with only one element in each row and each column being 1 and all the other elements being 0, and $D(\omega)=\mathrm{diag}[d_1(\omega),d_2(\omega))]$ is a diagonal matrix representing the amplitude ambiguity. Therefore, these problems need to be addressed in order to obtain meaningful separated signals for recovering.

In the frequency domain, on the assumption that its real and imaginary parts have the mean 0 and the same variance and are uncorrelated, each sound source spectrum $s_i(\omega,k)$ (i=1,2) is formulated as follows.

First, at a frequency ω, a separation weight $h_n(\omega)$ (n=1,2) is obtained according to the FastICA algorithm, which is a modification of the Independent Component Analysis algorithm, as shown in Equations (6) and (7):

$$h_n^+(\omega) = \frac{1}{K}\sum_{k=0}^{K-1}\{x(\omega,k)\overline{u}_n(\omega,k)f(|u_n(\omega,k)|^2) - [f(|u_n(\omega,k)|^2) + |u_n(\omega,k)|^2 f^-(|u_n(\omega,k)|^2)]h_n(\omega)\} \tag{6}$$

$$h_n(\omega) = h_n^+(\omega)/\|h_n^+(\omega)\| \tag{7}$$

where $f(|u_n(\omega,k)|^2)$ is a nonlinear function, and $f'(|u_n(\omega,k)|^2)$ is the derivative of $f(|u_n(\omega,k)|^2)$, is a conjugate sign, and K is the number of frames.

This algorithm is repeated until a convergence condition CC shown in Equation (8):

$$CC=\overline{h}_n^T(\omega)h_n^+(\omega)\simeq 1 \tag{8}$$

is satisfied (for example, CC becomes greater than or equal to 0.9999). Further, $h_2(\omega)$ is orthogonalized with $h_1(\omega)$ as in Equation (9):

$$h_2(\omega)=h_2(\omega)-h_1(\omega)\overline{h}_1^T(\omega)h_2(\omega) \tag{9}$$

and normalized as in Equation (7) again.

The aforesaid FastICA algorithm is carried out for each frequency ω. The obtained separation weights $h_n(\omega)$ (n=1,2) determine $H(\omega)$ as in Equation (10):

$$H(\omega) = \begin{bmatrix} \overline{h}_1^T(\omega) \\ \overline{h}_2^T(\omega) \end{bmatrix} \tag{10}$$

which is used in Equation (4) to calculate the separated signal spectra $u(\omega,k)=[U_1(\omega,k),U_2(\omega,k)]^T$ at each frequency. As shown in FIG. 2, two nodes where the separated signal spectra $U_1(\omega,k)$ and $U_2(\omega,k)$ are outputted are referred to as 1 and 2.

The split spectra $v_1(\omega,k)=([v_{11}(\omega,k),v_{12}(\omega,k)]^T$ and $v_2(\omega,k)=[v_{21}(\omega,k),v_{22}(\omega,k)]^T$ are defined as spectra generated as a pair (1 and 2) at nodes n(=1, 2) from the separated signal spectra $U_1(\omega,k)$ and $U_2(\omega,k)$ respectively, as shown in Equations (11) and (12):

$$\begin{bmatrix} v_{11}(\omega,k) \\ v_{12}(\omega,k) \end{bmatrix} = (H(\omega)Q(\omega))^{-1}\begin{bmatrix} U_1(\omega,k) \\ 0 \end{bmatrix} \tag{11}$$

$$\begin{bmatrix} v_{21}(\omega,k) \\ v_{22}(\omega,k) \end{bmatrix} = (H(\omega)Q(\omega))^{-1}\begin{bmatrix} 0 \\ U_2(\omega,k) \end{bmatrix} \tag{12}$$

If the permutation is not occurring but the amplitude ambiguity exists, the separated signal spectra $U_n(\omega,k)$ are outputted as in Equation (13):

$$\begin{bmatrix} U_1(\omega,k) \\ U_2(\omega,k) \end{bmatrix} = \begin{bmatrix} d_1(\omega) & s_1(\omega,k) \\ d_2(\omega) & s_2(\omega,k) \end{bmatrix} \tag{13}$$

Then, the split spectra for the above separated signal spectra $U_n(\omega,k)$ are generated as in Equations (14) and (15):

$$\begin{bmatrix} v_{11}(\omega,k) \\ v_{12}(\omega,k) \end{bmatrix} = \begin{bmatrix} g_{11}(\omega) & s_1(\omega,k) \\ g_{21}(\omega) & s_1(\omega,k) \end{bmatrix} \tag{14}$$

$$\begin{bmatrix} v_{21}(\omega,k) \\ v_{22}(\omega,k) \end{bmatrix} = \begin{bmatrix} g_{12}(\omega) & s_2(\omega,k) \\ g_{22}(\omega) & s_2(\omega,k) \end{bmatrix} \tag{15}$$

which show that the split spectra at each node are expressed as the product of the spectrum $s_1(\omega,k)$ and the transfer function, or the product of the spectrum $s_2(\omega,k)$ and the transfer function. Note here that $g_{11}(\omega)$ is a transfer function from the sound source 11 to the first microphone 13, $g_{21}(\omega)$ is a transfer function from the sound source 11 to the second microphone 14, $g_{12}(\omega)$ is a transfer function from the sound source 12 to the first microphone 13, and $g_{22}(\omega)$ is a transfer function from the sound source 12 to the second microphone 14.

If there are both permutation and amplitude ambiguity, the separated signal spectra $U_n(\omega,k)$ are expressed as in Equation (16):

$$\begin{bmatrix} U_1(\omega,k) \\ U_2(\omega,k) \end{bmatrix} = \begin{bmatrix} d_1(\omega) & s_2(\omega,k) \\ d_2(\omega) & s_1(\omega,k) \end{bmatrix} \tag{16}$$

and the split spectra at the nodes 1 and 2 are generated as in Equations (17) and (18):

$$\begin{bmatrix} v_{11}(\omega,k) \\ v_{12}(\omega,k) \end{bmatrix} = \begin{bmatrix} g_{12}(\omega) & s_2(\omega,k) \\ g_{22}(\omega) & s_2(\omega,k) \end{bmatrix} \tag{17}$$

$$\begin{bmatrix} v_{21}(\omega,k) \\ v_{22}(\omega,k) \end{bmatrix} = \begin{bmatrix} g_{11}(\omega) & s_1(\omega,k) \\ g_{21}(\omega) & s_1(\omega,k) \end{bmatrix} \tag{18}$$

In the above, the spectrum $v_{11}(\omega,k)$ generated at the node 1 represents the signal spectrum $s_2(\omega,k)$ transmitted from the sound source 12 and observed at the first microphone 13, the spectrum $V_{12}(\omega,k)$ generated at the node 1 represents the signal spectrum $s_2(\omega,k)$ transmitted from the sound source 12 and observed at the second microphone 14, the spectrum $v_{21}(\omega,k)$ generated at the node 2 represents the signal spectrum $s_1(\omega,k)$ transmitted from the sound source 11 and observed at the first microphone 13, and the spectrum $v_{22}(\omega,k)$ generated at the node 2 represents the signal spectrum $s_1(\omega,k)$ transmitted from the sound source 11 and observed at the second microphone 14.

The four spectra $v_{11}(\omega,k)$, $v_{12}(\omega,k)$, $v_{21}(\omega,k)$ and $v_{22}(\omega,k)$ shown in FIG. 2 can be separated into two groups, each consisting of two split spectra. One of the groups corresponds to one sound source, and the other corresponds to the other sound source. For example, in the absence of permutation, $v_{11}(\omega,k)$ and $v_{12}(\omega,k)$ correspond to one sound source; and in the presence of permutation, $v_{21}(\omega,k)$ and $v_{22}(\omega,k)$ correspond to the one sound source. Due to sound transmission characteristics, for example, sound intensities, that depend on the four different distances between the first and second microphones and the two sound sources, spectral intensities of the split spectra $v_{11}$, $v_{12}$, $v_{21}$, and $v_{22}$ differ from one another. Therefore, if distinctive distances are provided between the microphones and the sound sources, it is possible to determine which microphone received which sound source's signal. That is, it is possible to identify the sound source for each of the split spectra $v_{11}$, $v_{12}$, $v_{21}$, and $v_{22}$.

Here, it is assumed that the sound source 11 is closer to the first microphone 13 than to the second microphone 14 and that the sound source 12 is closer to the second microphone 14 than to the first microphone 13. In this case, comparison of transmission characteristics between the two possible paths from the sound source 11 to the microphones 13 and 14 provides a gain comparison as in Equation (19):

$$|g_{11}(\omega)|>|g_{21}(\omega)| \tag{19}$$

Similarly, by comparing transmission characteristics between the two possible paths from the sound source 12 to the microphones 13 and 14, a gain comparison is obtained as in Equation (20):

$$|g_{12}(\omega)|<|g_{22}(\omega)| \tag{20}$$

In this case, when Equations (14) and (15) or Equations (17) and (18) are used with the gain comparison in Equations (19) and (20), if there is no permutation, calculation of the difference $D_1$ between the spectra $v_{11}$ and $v_{12}$ and the difference $D_2$ between the spectra $v_{21}$ and $v_{22}$ shows that $D_1$ at the node 1 is positive and $D_2$ at the node 2 is negative. On the other hand, if there is permutation, the similar analysis shows that $D_1$ at the node 1 is negative and $D_2$ at the node 2 is positive.

In other words, the occurrence of permutation is recognized by examining the differences $D_1$ and $D_2$ between respective split spectra: if $D_1$ at the node 1 is positive and $D_2$ at the node 2 is negative, the permutation is considered not occurring; and if $D_1$ at the node 1 is negative and $D_2$ at the node 2 is positive, the permutation is considered occurring.

In case the difference $D_1$ is calculated as a difference between absolute values of the spectra $v_{11}$ and $v_{12}$, and the difference $D_2$ is calculated as a difference between absolute values of the spectra $v_{21}$ and $v_{22}$, the differences $D_1$ and $D_2$ are expressed as in Equations (21) and (22), respectively:

$$D_1=|v_{11}(\omega,k)|-|v_{12}(\omega,k)| \tag{21}$$

$$D_2=|v_{21}(\omega,k)|-|v_{22}(\omega,k)| \tag{22}$$

If there is no permutation, $v_{11}(\omega,k)$ is selected as a spectrum $y_1(\omega,k)$ of the signal from the one sound source that is closer to the first microphone 13 than to the second microphone 14. This is because the spectral intensity of $v_{11}(\omega,k)$ observed at the first microphone 13 is greater than the spectral intensity of $v_{12}(\omega,k)$ observed at the second microphone 14, and $v_{11}(\omega,k)$ is less subject to the background noise than $v_{12}(\omega,k)$. Also, if there is permutation, $v_{21}(\omega,k)$ is selected as the spectrum $y_1(\omega,k)$ for the one sound source. Therefore, the spectrum $y_1(\omega,k)$ for the one sound source is expressed as in Equation (23):

$$y_1(\omega,k)=\begin{cases} v_{11}(\omega,k) & \text{if } D_1>0, D_2<0 \\ v_{21}(\omega,k) & \text{if } D_1<0, D_2>0 \end{cases} \tag{23}$$

Similarly for a spectrum $y_2(\omega,k)$ for the other sound source, the spectrum $v_{22}(\omega,k)$ is selected if there is no permutation, and the spectrum $v_{12}(\omega,k)$ is selected if there is permutation as in Equation (24):

$$y_2(\omega,k)=\begin{cases} v_{12}(\omega,k) & \text{if } D_1<0, D_2>0 \\ v_{22}(\omega,k) & \text{if } D_1>0, D_2<0 \end{cases} \tag{24}$$

The permutation occurrence is determined by using Equations (21) and (22).

The FastICA method is characterized by its capability of sequentially separating signals from the mixed signals in descending order of non-Gaussianity. Speech generally has higher non-Gaussianity than noises. Thus, if observed sounds consist of the target speech (i.e., speaker's speech) and the noise, it is highly probable that a split spectrum corresponding to the speaker's speech is in the separated signal $U_1$, which is the first output of this method. Thus, if the one sound source is the speaker, the permutation occurrence is highly unlikely; and if the other sound source is the speaker, the permutation occurrence is highly likely.

Therefore, while the spectra $y_1$ and $y_2$ are generated, the number of permutation occurrences $N^-$ and the number of non-occurrences $N^+$ over all the frequencies are counted, and the estimated spectra Y* and Y are determined by using the criteria given as:

(a) if the count $N^+$ is greater than the count $N^-$, select the spectrum $y_1$ as the estimated spectrum Y* and select the spectrum $y_2$ as the estimated spectrum Y; or (b) if the count $N^-$ is greater than the count $N^+$, select the spectrum $Y_2$ as the estimated spectrum Y* and select the spectrum $y_1$ as the estimated spectrum Y.

2. Second Step

Figure 3:
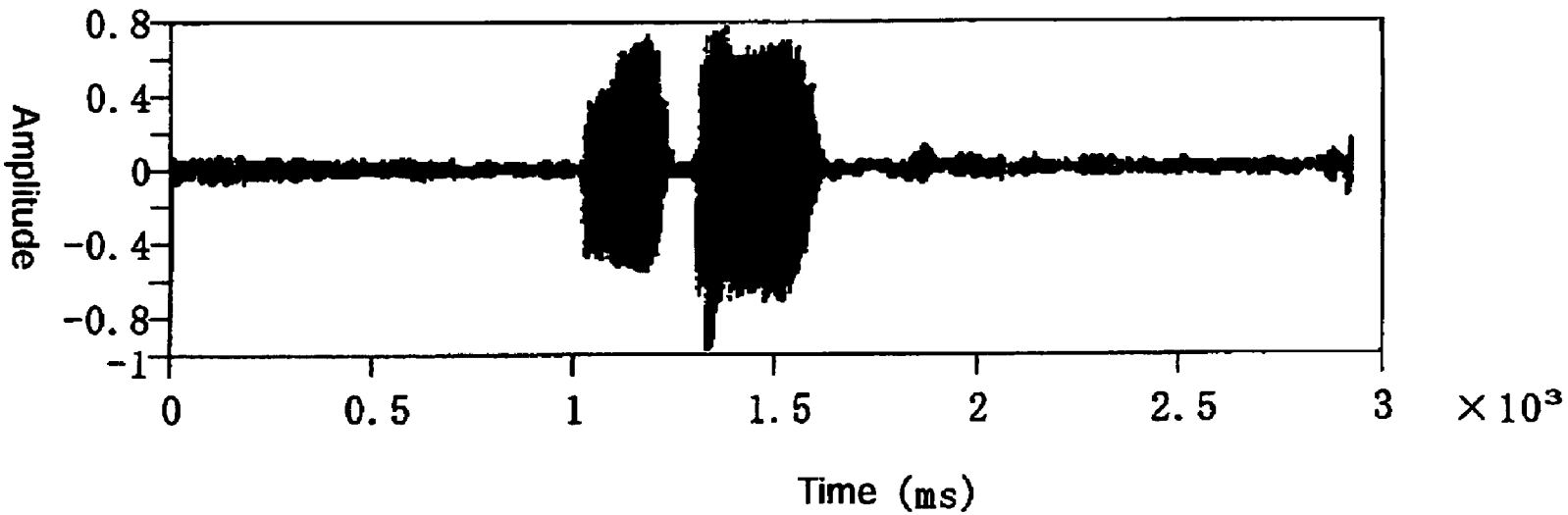
FIG. 3 is a graph showing the waveform of the recovered signal of the target speech, which is obtained after performing the inverse Fourier transform of the recovered spectrum group comprising the estimated spectra Y*.

FIG. 3 shows the waveform of the target speech ("Tokyo"), which was obtained after the inverse transform of the recovered spectrum group comprising the estimated spectra as obtained above. It can be seen in this figure that the noise signal still remains in the recovered signal of the target speech.

Figure 4:
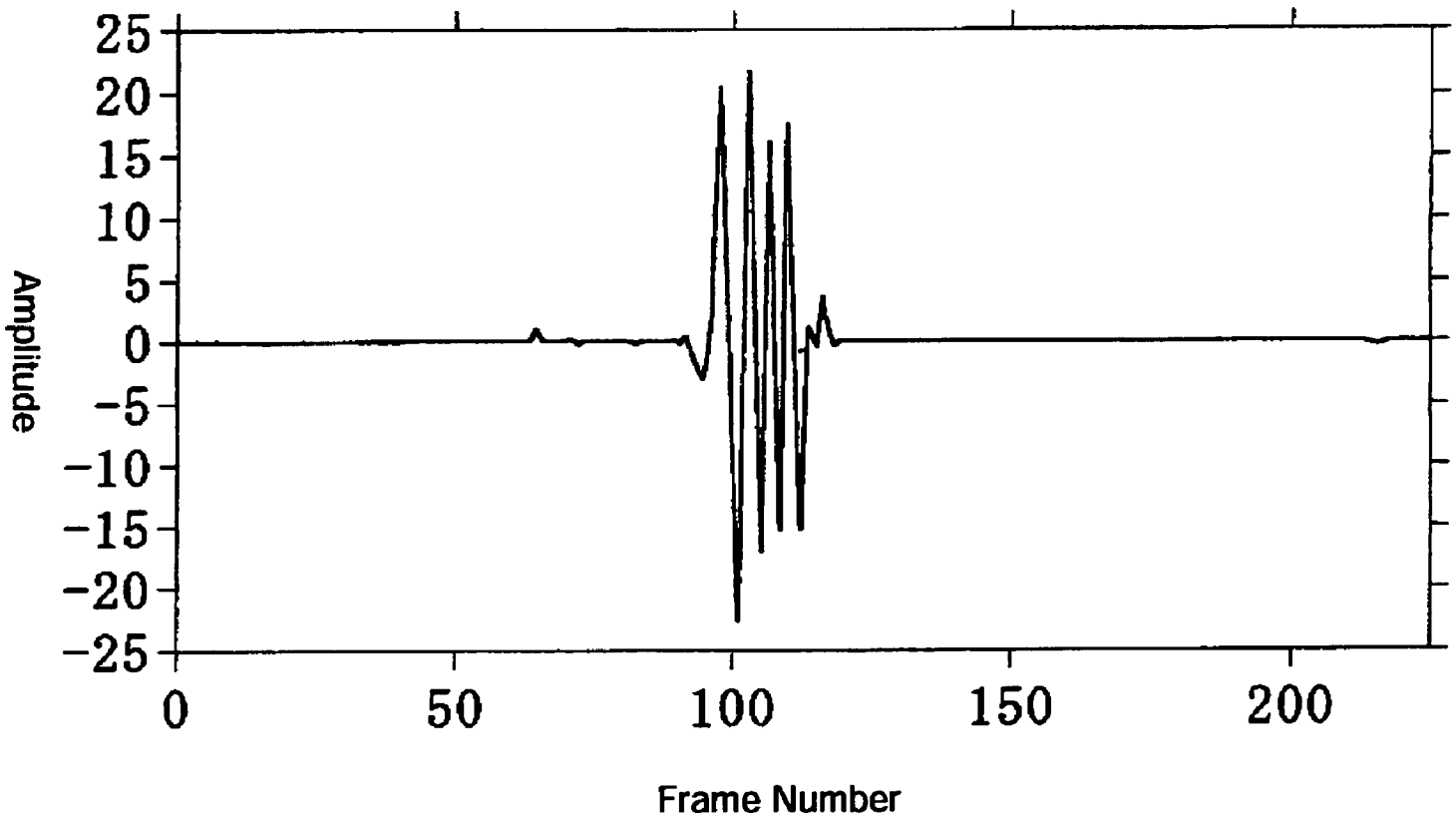
FIG. 4 is a graph showing an estimated spectrum series in y* in which the noise is removed.
Figure 5:
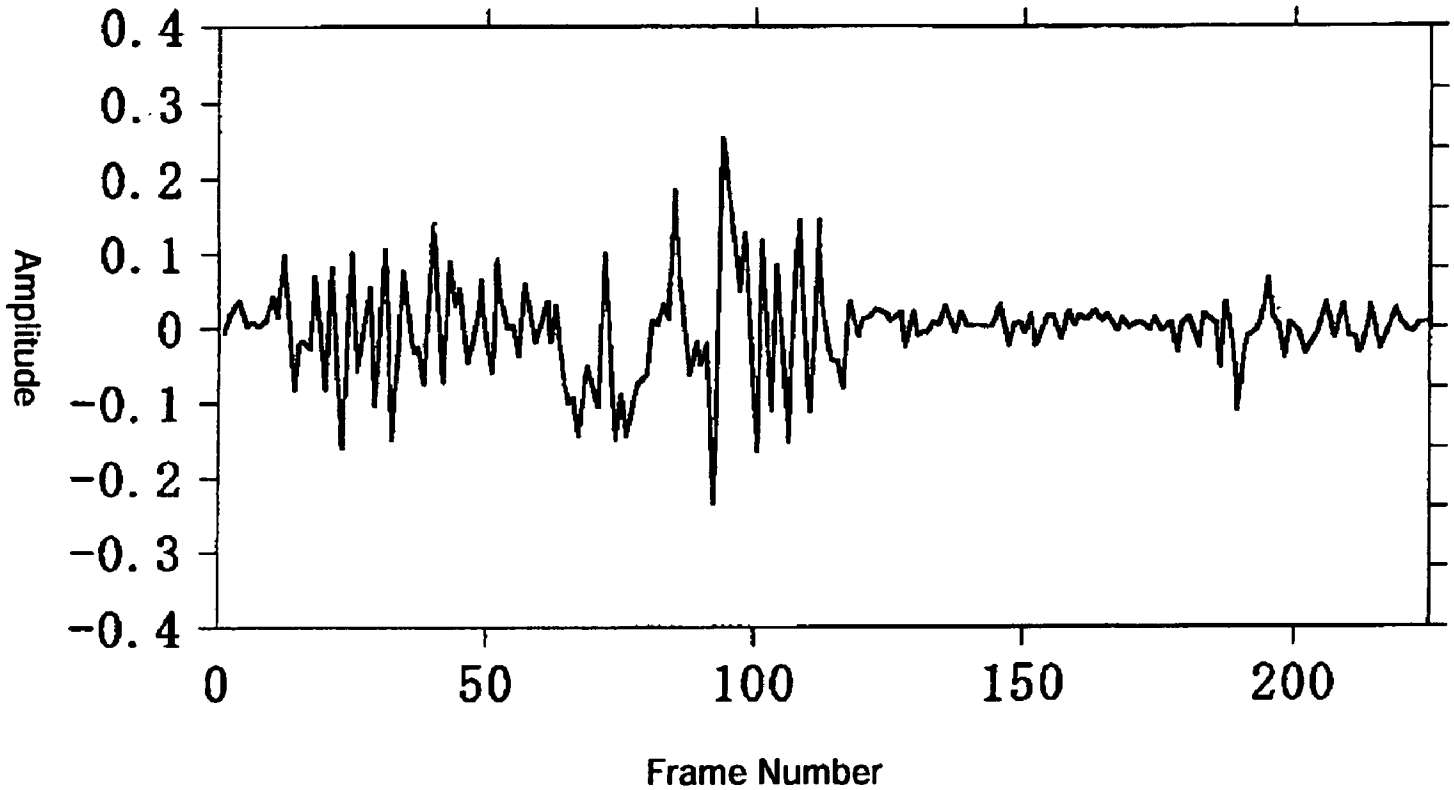
FIG. 5 is a graph showing an estimated spectrum series in y in which the noise remains.

Therefore, the estimated spectrum series at each frequency was investigated. It was found that the noise had been removed from some of the estimated spectrum series in Y*, and an example is shown in FIG. 4, and the noise still remains in the other estimated spectrum series in Y*, and an example is shown in FIG. 5. In the estimated spectrum series in which the noise has been removed, the amplitude is large in the speech segment, and is extremely small in the non-speech segment, clearly defining the start and end points of the speech segment. Thus, it is expected that by using only the estimated spectrum series in which the noise has been removed, the speech segment can be obtained accurately.

Figure 6:
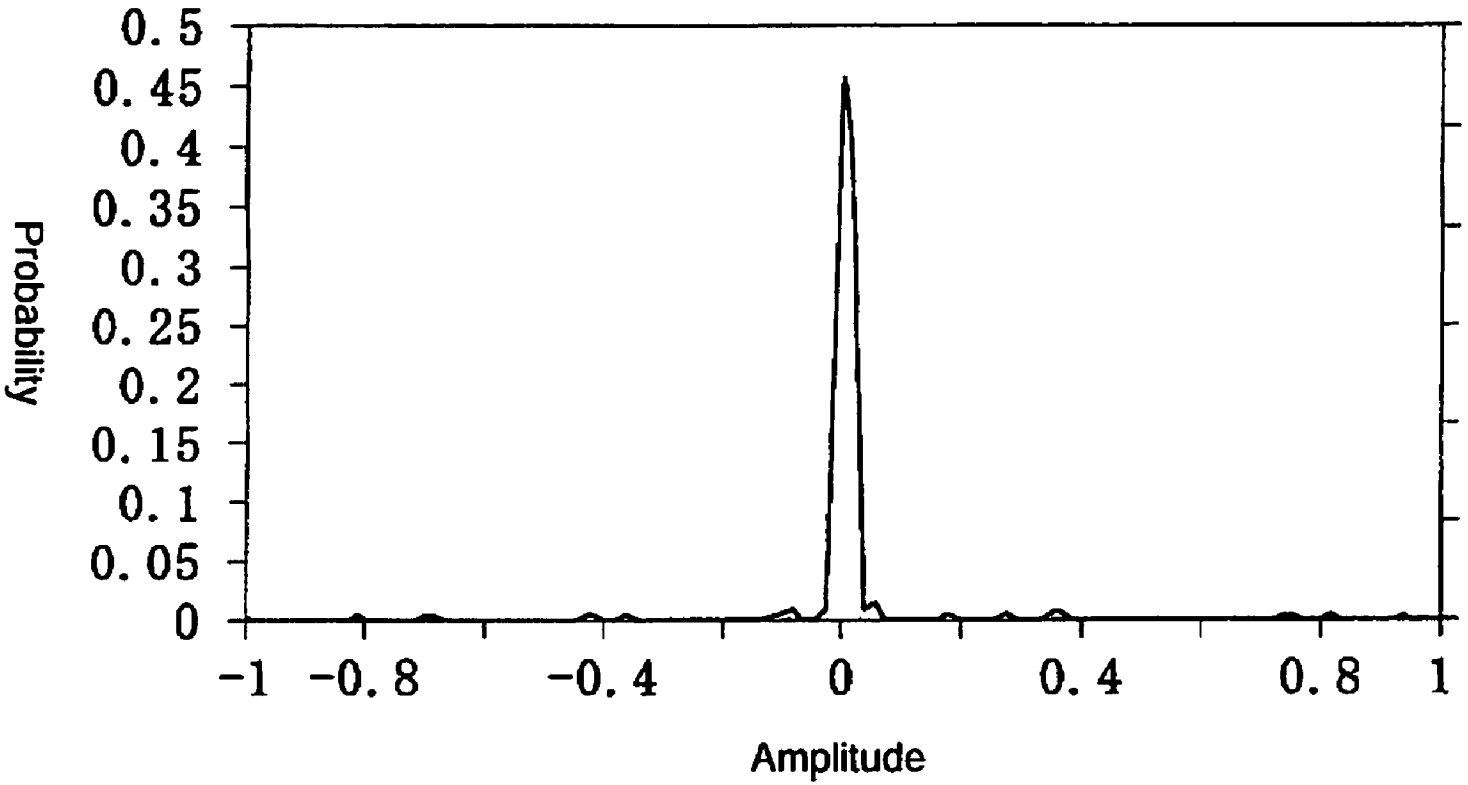
FIG. 6 is a graph showing the amplitude distribution of the estimated spectrum series in y* in which the noise is removed.
Figure 7:
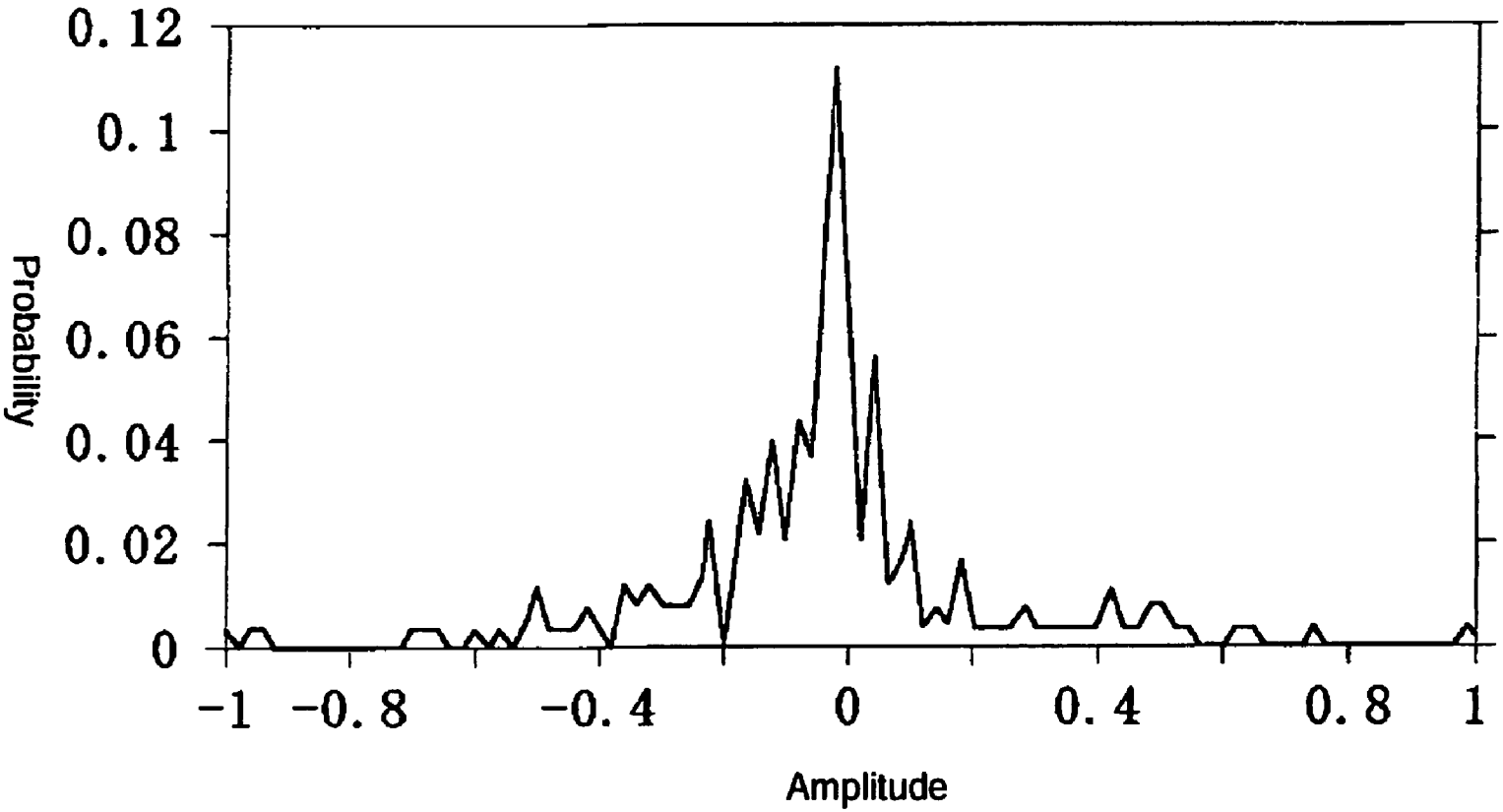
FIG. 7 is a graph showing the amplitude distribution of the estimated spectrum series in y in which the noise remains.

FIG. 6 shows the amplitude distribution of the estimated spectrum series in FIG. 4; and FIG. 7 shows the amplitude distribution of the estimated spectrum series in FIG. 5. It can be seen from these figures that the amplitude distribution of the estimated spectrum series in which the noise has been removed has a high kurtosis; and the amplitude distribution of the estimated spectrum series in which the noise remains has a low kurtosis. Therefore, by applying separation judgment criteria based on the kurtosis of the amplitude distribution of each of the estimated spectrum series in Y*, it is possible to separate the estimated spectra Y* into an estimated spectrum series group y* in which the noise has been removed and an estimated spectrum series group y in which the noise remains.

In order to quantitatively evaluate kurtosis values, entropy E of an amplitude distribution may be employed. The entropy E represents uncertainty of a main amplitude value. Thus, when the kurtosis is high, the entropy is low; and when the kurtosis is low, the entropy is high. Therefore, by use of a predetermined threshold value α, the separation judgment criteria are given as:

(1) if the entropy E of an estimated spectrum series in Y* is less than the threshold value α, the estimated spectrum series in Y* is assigned to y*; and (2) if the entropy E of an estimated spectrum series in Y* is greater than or equal to the threshold value α, the estimated spectrum series in Y* is assigned to y.

The entropy is defined as in the following Equation (25):

$$E(\omega) = -\sum_{n=1}^{N} p_\omega(1_n)\log p_\omega(1_n) \tag{25}$$

where $p_\omega(1_n)$ (n=1, 2, . . . , N) is a probability, which is equivalent to $q_\omega(1_n)$ (n=1, 2, . . . , N) normalized as in the following Equation (26). Here, $1_n$ indicates the n-th interval when the amplitude distribution range is divided into N equal intervals for the real part of an estimated spectrum series at each frequency in Y*, and $q_\omega(1_n)$ is a frequency of occurrence within the n-th interval.

$$p_\omega(1_n) = q_\omega(1_n) \Big/ \sum_{n=1}^{N} q_\omega(1_n) \tag{26}$$

3. Third Step

Figure 8:
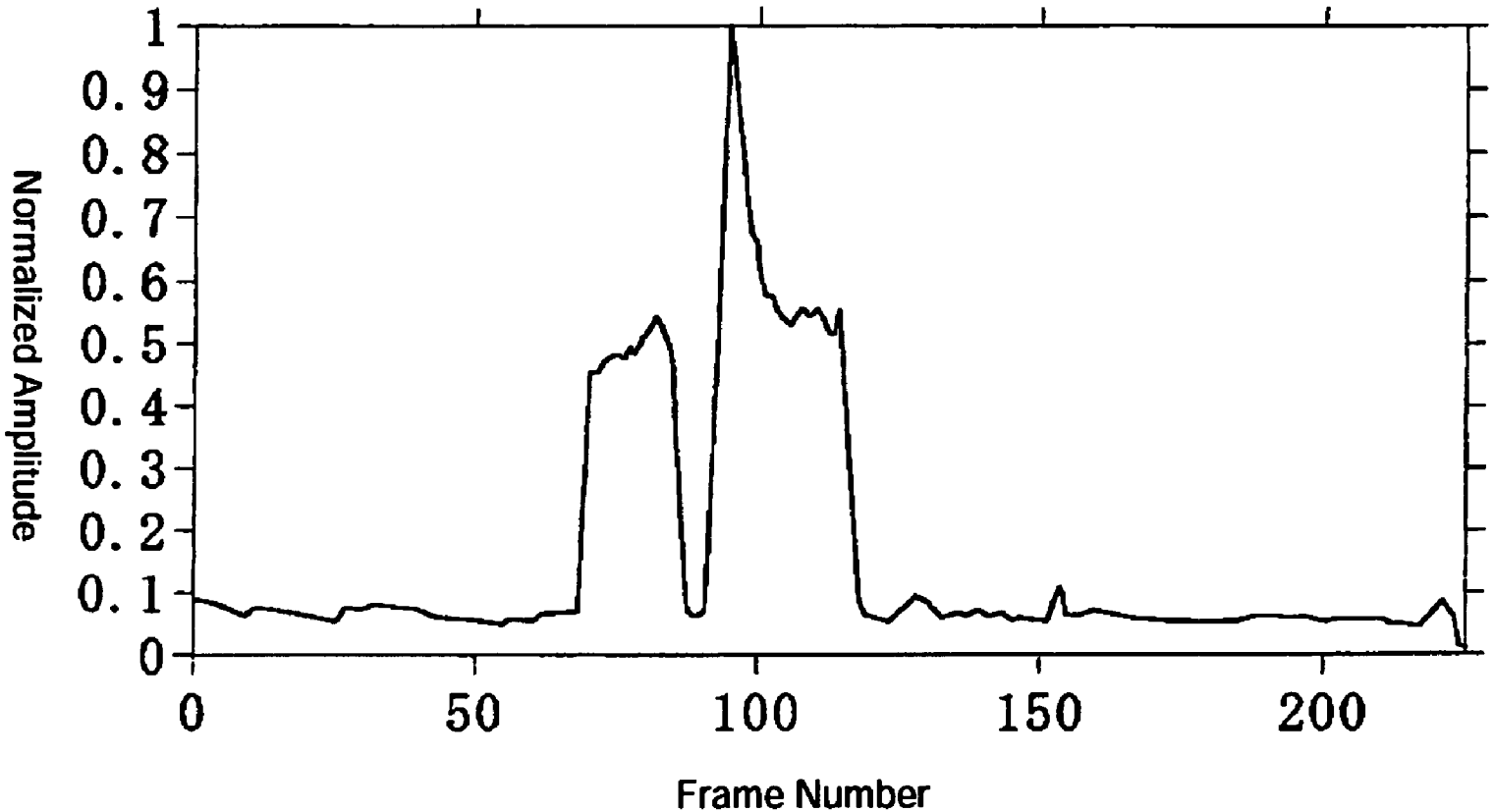
FIG. 8 is a graph showing the total sum of all the estimated spectrum series in y*.
Figure 9:
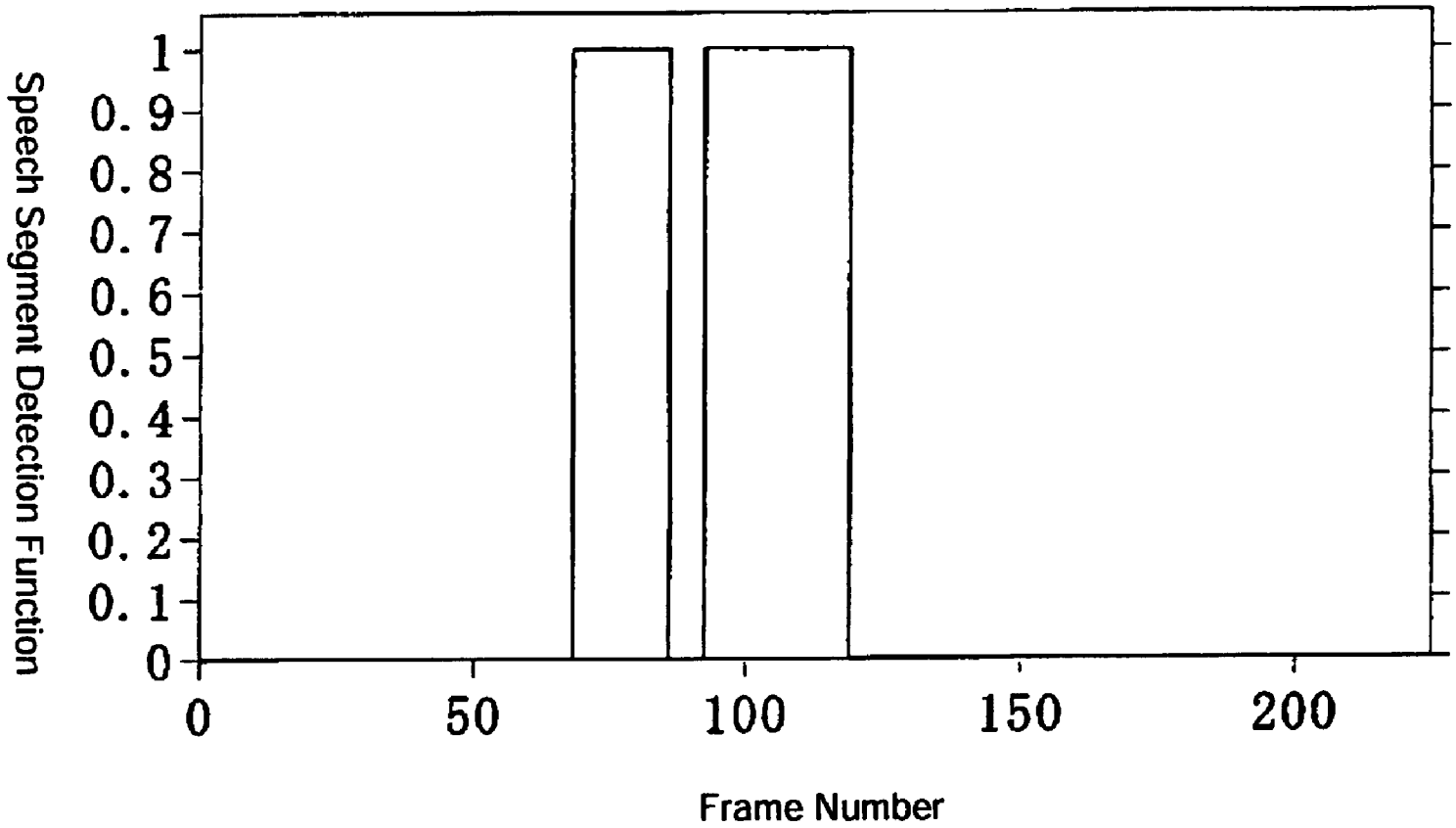
FIG. 9 is a graph showing the speech segment detection function.

Since the frequency components of a speech signal varies with time, the frame-number range characterizing speech varies from an estimated spectrum series to an estimated spectrum series in y*. By taking a summation of all the estimated spectrum series in y* at each frame number, the frame-number range characterizing the speech can be clearly defined. An example of the total sum F of all the estimated spectrum series in y* is shown in FIG. 8, where each amplitude value is normalized by the maximum value (which is 1 in FIG. 8). By specifying a threshold value β depending on the maximum value of F, the frame number range where F is greater than β may be defined as the speech segment, and the frame number range where F is less than or equal to β may be defined as the noise segment. Therefore, by applying the detection judgment criteria based on the amplitude distribution in FIG. 8 and the threshold value β, a speech segment detection function F*(k) is obtained, where F*(k) is a two-valued function which is 1 when F>β, and is 0 when F<β.

4. Fourth Step

By multiplying each estimated spectrum series in Y* by the speech segment detection function F*(k), it is possible to extract only the components falling in the speech segment from the estimated spectrum series. Thereafter, the recovered spectrum group {Z(ω, k)|k=0, 1, . . . , K−1} can be generated from all the estimated spectrum series in Y*, each having non-zero components only in the speech segment. The recovered signal of the target speech Z(t) is thus obtained by performing the inverse Fourier transform of the recovered spectrum group {Z(ω,k)|k=0, 1, . . . , K−1} for each frame back to the time domain, and then taking the summation over all the frames as in Equation (27):

$$Z(t) = \frac{1}{2\pi}\frac{1}{W(t)}\sum_k \sum_\omega e^{\sqrt{-1}\,\omega(t-k\tau)} Z(\omega, k) \tag{27}$$

$$W(t) = \sum_{kw} (t - k\tau)$$

Figure 10:
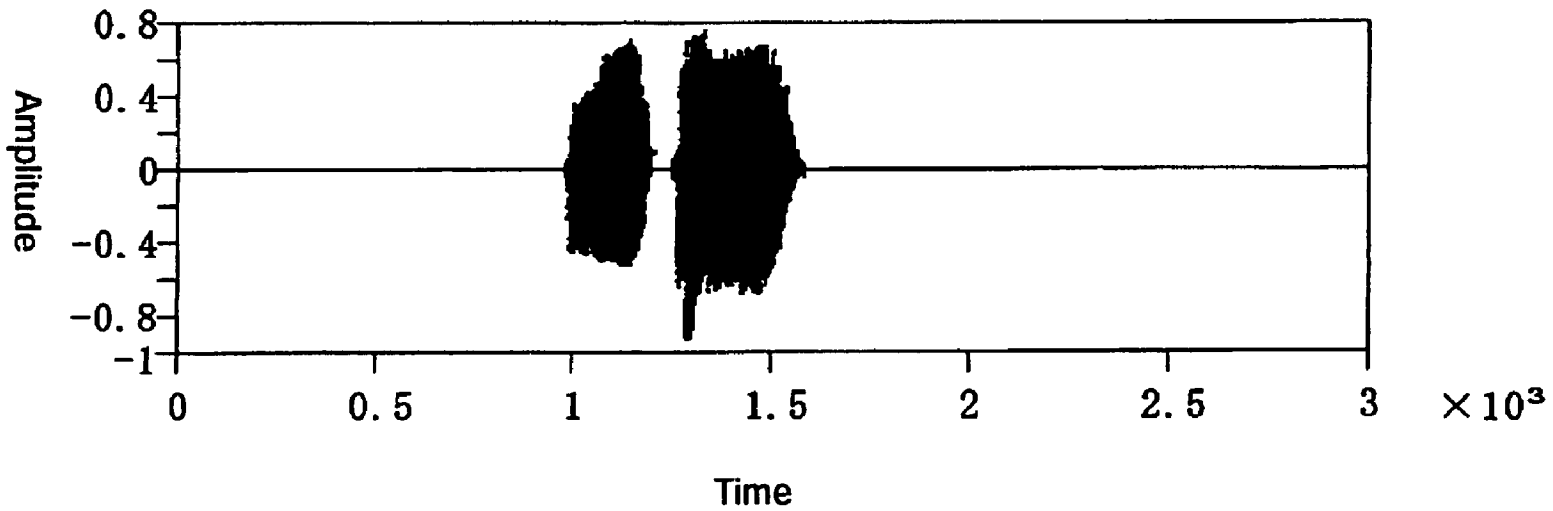
FIG. 10 is a graph showing the waveform of the recovered signal of the target speech after performing the inverse Fourier transform of the recovered spectrum group, which is obtained by extracting components falling in the speech segment from the estimated spectra Y*.

FIG. 10 shows the recovered signal of the target speech after the inverse Fourier transform of the recovered spectrum group, which is obtained by multiplying each spectrum series in Y* by the speech segment detection function. It is clear upon comparing FIGS. 3 and 10 that there is no noise remaining in the recovered target speech in FIG. 10 unlike the recovered target speech in FIG. 3.

The method for recovering target speech based on speech segment detection under a stationary noise according to the second embodiment of the present invention comprises: the first step of receiving a signal $s_1(t)$ from the sound source 11 and a signal $s_2(t)$ from the sound source 12 (one of which is a target speech source and the other is a noise source) at the first and second microphones 13 and 14 and forming mixed signals $x_1(t)$ and $x_2(t)$ at the first microphone 13 and at the second microphone 14 respectively, performing the Fourier transform of the mixed signals $x_1(t)$ and $x_2(t)$ from the time domain to the frequency domain, and extracting the estimated spectra Y* and Y corresponding to the target speech and the noise by use of the Fast ICA, as shown in FIG. 2; the second step of separating the estimated spectra Y* into an estimated spectrum series group y* in which the noise is removed and an estimated spectrum series group y in which the noise remains by applying separation judgment criteria based on the kurtosis of the amplitude distribution of each of the estimated spectrum series in Y*; the third step of detecting a speech segment and a noise segment in the time domain of a total sum F of all the estimated spectrum series in y* by applying detection judgment criteria based on a threshold value β that is determined by the maximum value of F; and the fourth step of performing the inverse Fourier transform of the estimated spectra Y* from the frequency domain to the time domain to generate a recovered signal of the target speech and extracting components falling in the speech segment from the recovered signal of the target speech to recover the target speech.

The differences in method between the first and second embodiments are in the third and fourth steps. In the second embodiment, the speech segment is obtained in the time domain, and the target speech is recovered by extracting the components falling in the speech segment from the recovered signal of the target speech in the time domain. Therefore, only the third and fourth steps are explained below.

The relationship between the frame number k and the sampling time t is expressed as: $\tau(k-1)<t\leqq\tau k$, where τ is the frame interval. Thus $k=[t/\tau]$ holds, where $[t/\tau]$ is a Ceiling symbol indicating the smallest integer among all the integers larger than $t/\tau$, and a speech segment detection function in the time domain F*(t) can be defined as: F*(t)=1 in the range where $F^*([t/\tau])=1$; and F*(t)=0 in the range where $F^*([t/\tau])=0$. Therefore, in the third step in the second embodiment, the speech segment is defined as the range in the time domain where $F^*([t/\tau])=1$ holds; and the noise segment is defined as the range in the time domain where $F^*([t/\tau])=0$ holds.

In the fourth step of the second embodiment, the recovered signal of the target speech, which is obtained after the inverse Fourier transform of the estimated spectra Y* from the frequency domain to the time domain, is multiplied by F*(t), which is the speech segment detection function in the time domain, to extract the target speech signal.

The resultant target speech signal is amplified by the recovered signal amplifier 18 and inputted to the loudspeaker 19.

(A) EXAMPLE 1

Figure 11:
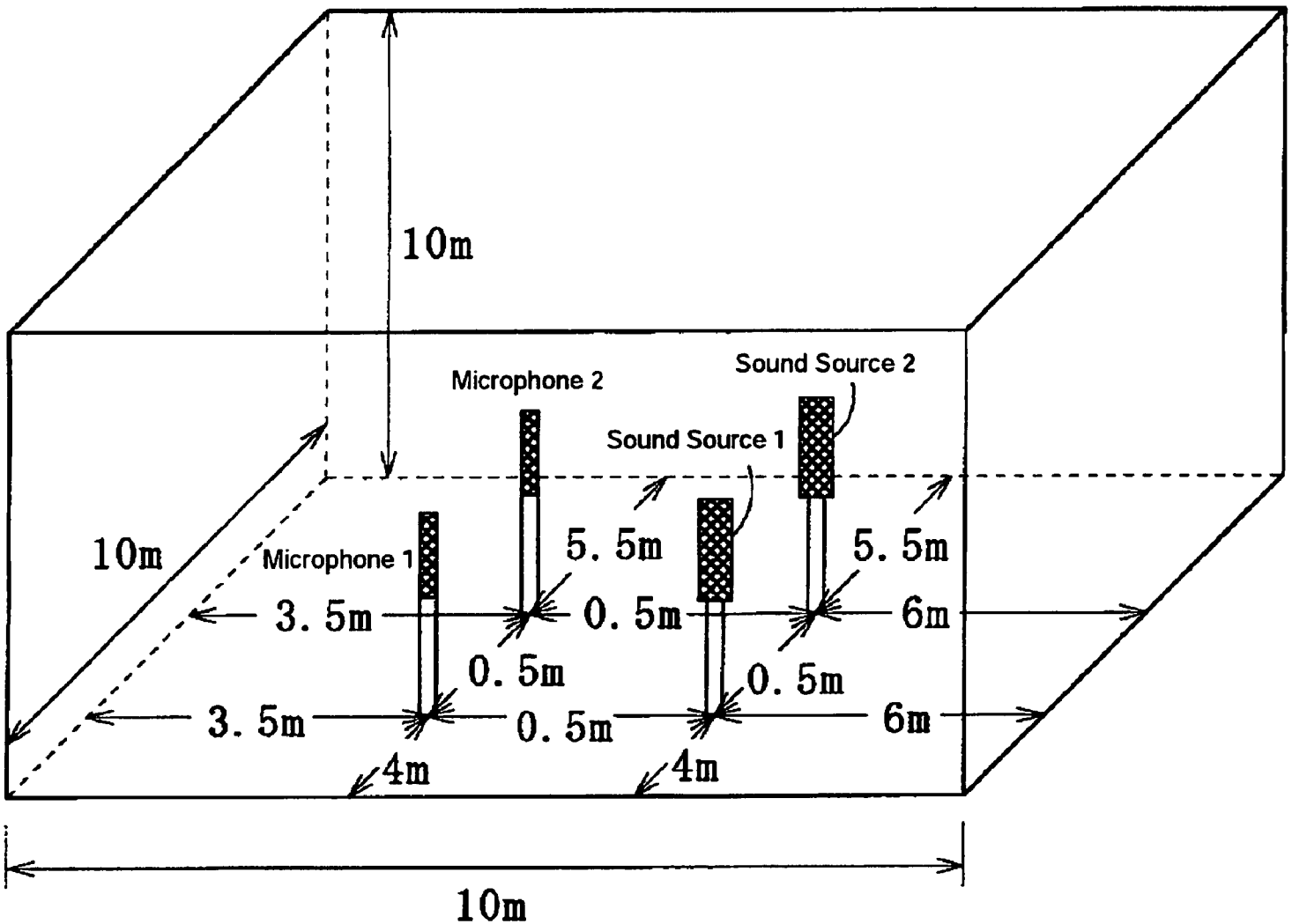
FIG. 11 is a perspective view of the virtual room, where the locations of the sound sources and microphones are shown as employed in the Examples 1 and 2.

Experiments were conducted in a virtual room with 10 m length, 10 m width, and 10 m height. Microphones 1 and 2 and sound sources 1 and 2 were placed in the room as in the FIG. 11. The mixed signals received at the microphones 1 and 2 were analyzed by use of the FastICA, and a noise was removed to recover the target speech. The detection accuracy of the speech segment was evaluated.

The distance between the microphones 1 and 2 was 0.5 m; the distance between the two sound sources 1 and 2 was 0.5 m; the microphones were placed 1 m above the floor level; the two sound sources were placed 0.5 m above the floor level; the distance between the microphone 1 and the sound source 1 was 0.5 m; and the distance between the microphone 2 and the sound source 2 was 0.5 m. The FastICA was carried out by employing the method described in *"Permutation Correction and Speech Extraction Based on Split Spectrum through Fast ICA"* by H. Gotanda, K. Nobu, T. Koya, K Kaneda, and T. Ishibashi, Proc. of International Symposium on Independent Component Analysis and Blind Signal Separation, Apr. 1, 2003, pp. 379-384. At the sound source 1, each of two speakers (one male and one female) was placed and spoke five difference words (zairyo, iyoiyo, urayamasii, omosiroi, and guai), emitting total of ten different speech patterns. At the sound source 2, five different stationary noises (f16 noise, volvo noise, white noise, pink noise, and tank noise) selected from Noisex-92 Database (http://spib.rice.edu/spib) were emitted. From the above, total of 50 different mixed signals were generated.

The speech segment detection function $F^*(k)$ is two-valued depending on the total sum F with respect to the threshold value $\beta$, and the total sum F is determined from the estimated spectrum series group $y^*$ which is separated from the estimated spectra $Y^*$ according to the threshold value $\alpha$; thus, the speech segment detection accuracy depends on $\alpha$ and $\beta$. Investigation was made to determine optimal values for $\alpha$ and $\beta$. The optimal values for $\alpha$ were found to be 1.8-2.3; and the optimal values for $\beta$ were found to be 0.05-0.15. The values of $\alpha=2.0$ and $\beta=0.08$ were selected.

The start and end points of the speech segment were obtained according to the present method. Also, a visual inspection on the waveform of the target speech signal recovered from the estimated spectra $Y^*$ was carried out to visually determine the start and end points of the speech segment. The comparison between the two methods revealed that the start point of the speech segment determined according to the present method was −2.71 msec (with a standard deviation of 13.49 msec) with respect to the start point determined by the visual inspection; and the end point of the speech segment determined according to the present method was −4.96 msec (with a standard deviation of 26.07 msec) with respect to the end point determined by the visual inspection. Therefore, the present method had a tendency of detecting the speech segment earlier that the visual inspection. Nonetheless, the difference in the speech segment between the two methods was very small, and the present method detected the speech segment with reasonable accuracy.

(B) EXAMPLE 2

At the sound source 2, five different non-stationary noises (office, restaurant, classical, station, and street) selected from NTT Noise Database (*Ambient Noise Database for Telephonometry*, NTT Advanced Technology Inc., 1996) were emitted. Experiments were conducted with the same conditions as in Example 1.

The results showed that the start point of the speech segment determined according to the present method was −2.36 msec (with a standard deviation of 14.12 msec) with respect to the start point determined by the visual inspection; and the end point of the speech segment determined according to the present method was −13.40 msec (with a standard deviation of 44.12 msec) with respect to the end point determined by the visual inspection. Therefore, the present method is capable of detecting the speech segment with reasonable accuracy, functioning almost as well as the visual inspection even for the case of a non-stationary noise.

While the invention has been so described, the present invention is not limited to the aforesaid embodiments and can be modified variously without departing from the spirit and scope of the invention, and may be applied to cases in which the method for recovering target speech based on speech segment detection under a stationary noise according to the present invention is structured by combining part or entirety of each of the aforesaid embodiments and/or its modifications.

For example, in the present method, the FastICA is employed in order to extract the estimated spectra $Y^*$ and Y corresponding to the target speech and the noise respectively, but the extraction method does not have to be limited to this method. It is possible to extract the estimated spectra $Y^*$ and Y by using the ICA, resolving the scaling ambiguity based on the sound transmission characteristics that depend on the four different paths between the two microphones and the sound sources, and resolving the permutation problem based on the similarity of envelop curves of spectra at individual frequencies.

We claim:

1. A method for recovering target speech based on speech segment detection under a stationary noise, the method comprising:

a first step of receiving target speech emitted from a sound source and a noise emitted from another sound source and forming mixed signals at a first microphone and at a second microphone, which are provided at separate locations, performing the Fourier transform of the mixed signals from a time domain to a frequency domain, and extracting estimated spectra $Y^*$ and Y corresponding to the target speech and the noise by use of the Independent Component Analysis;

a second step of separating the estimated spectra $Y^*$ into an estimated spectrum series group $y^*$ in which the noise is removed and an estimated spectrum series group y in which the noise remains by applying separation judgment criteria based on a kurtosis of an amplitude distribution of each estimated spectrum series in $Y^*$;

a third step of detecting a speech segment and a noise segment in a frame number domain of a total sum F of all the estimated spectrum series in $y^*$ by applying detection judgment criteria based on a predetermined threshold value $\beta$ that is determined by a maximum value of F; and a fourth step of extracting components falling in the speech segment from each of the estimated spectrum series in $Y^*$ to generate a recovered spectrum group of the target speech, and performing the inverse Fourier transform of the recovered spectrum group from the frequency domain to the time domain to generate a recovered signal of the target speech.

2. The method set forth in claim 1, wherein the detection judgment criteria define the speech segment as a frame number range where the total sum F is greater than the threshold value β and the noise segment as a frame number range where the total sum F is less than or equal to the threshold value β.

3. The method set forth in claim 2, wherein the kurosis of the amplitude distribution of each of the estimated spectrum series in Y* is evaluated by means of entropy E of the amplitude distribution.

4. The method set forth in claim 1, wherein the kurosis of the amplitude distribution of each of the estimated spectrum series in Y* is evaluated by means of entropy E of the amplitude distribution.

5. The method set forth in claim 4, wherein the separation judgment criteria are given as:

(1) if the entropy E of an estimated spectrum series of Y* is less than a predetermined threshold value α, the estimated spectrum series in Y* is assigned to the estimated spectrum series group y*; and (2) if the entropy E of an estimated spectrum series in Y* is greater than or equal to the threshold value α, the estimated spectrum series in Y* is assigned to the estimated spectrum series group y.

6. A method for recovering target speech based on speech segment detection under a stationary noise, the method comprising:

a first step of receiving target speech emitted from a sound source and a noise emitted from another sound source and forming mixed signals at a first microphone and at a second microphone, which are provided at separate locations, performing the Fourier transform of the mixed signals from a time domain to a frequency domain, and extracting estimated spectra Y* and Y corresponding to the target speech and the noise by use of the Independent Component Analysis;

a second step of separating the estimated spectra Y* into an estimated spectrum series group y* in which the noise is removed and an estimated spectrum series group y in which the noise remains by applying separation judgment criteria based on a kurtosis of an amplitude distribution of each of estimated spectrum series in Y*;

a third step of detecting a speech segment and a noise segment in the time domain of a total sum F of all the estimated spectrum series in y* by applying detection judgment criteria based on a predetermined threshold value β that is determined by a maximum value of F; and a fourth step of performing the inverse Fourier transform of the estimated spectra Y* from the frequency domain to the time domain to generate a recovered signal of the target speech and extracting components falling in the speech segment from the recovered signal of the target speech to recover the target speech.

7. The method set forth in claim 6, wherein the detection judgment criteria define the speech segment as a time interval where the total sum F is greater than the threshold value β, and the noise segment as a time interval where the total sum F is less than or equal to the threshold value β.

8. The method set forth in claim 7, wherein the kurosis of the amplitude distribution of each of the estimated spectrum series in Y* is evaluated by means of entropy E of the amplitude distribution.

9. The method set forth in claim 6, wherein the kurosis of the amplitude distribution of each of the estimated spectrum series in Y* is evaluated by means of entropy E of the amplitude distribution.

* * * * *